US006999038B2

(12) United States Patent
Louzir et al.

(10) Patent No.: US 6,999,038 B2
(45) Date of Patent: Feb. 14, 2006

(54) DEVICE FOR RECEIVING AND/OR TRANSMITTING ELECTROMAGNETIC SIGNALS FOR USE IN THE FIELD OF WIRELESS TRANSMISSIONS

(75) Inventors: Ali Louzir, Rennes (FR); Françoise Le Bolzer, Rennes (FR)

(73) Assignee: Thomson Licensing, Boulogne-Billancourt (FR)

( * ) Notice: Subject to any disclaimer, the term of this patent is extended or adjusted under 35 U.S.C. 154(b) by 0 days.

(21) Appl. No.: 10/468,651

(22) PCT Filed: Feb. 4, 2002

(86) PCT No.: PCT/FR02/00408

§ 371 (c)(1),
(2), (4) Date: Feb. 4, 2004

(87) PCT Pub. No.: WO02/069446

PCT Pub. Date: Sep. 6, 2002

(65) Prior Publication Data

US 2004/0113841 A1 Jun. 17, 2004

(30) Foreign Application Priority Data

Feb. 23, 2001 (FR) ..... 01 02500

(51) Int. Cl.
*H01Q 13/10* (2006.01)

(52) U.S. Cl. ..... 343/770; 343/769; 343/700 MS

(58) Field of Classification Search ..... 343/767, 343/768, 769, 770, 700 MS, 746
See application file for complete search history.

(56) References Cited

U.S. PATENT DOCUMENTS

| | | | | |
|---|---|---|---|---|
| 5,174,961 | A | 12/1992 | Smith | 422/73 |
| 5,281,974 | A | 1/1994 | Kuramoto et al. | 343/700 |
| 6,028,561 | A * | 2/2000 | Takei | 343/767 |

FOREIGN PATENT DOCUMENTS

| | | |
|---|---|---|
| WO | 98/15030 | 4/1998 |

OTHER PUBLICATIONS

Copy of search report dated Jun. 20, 2002.

* cited by examiner

*Primary Examiner*—Hoang V. Nguyen
(74) *Attorney, Agent, or Firm*—Joseph S. Tripoli; Robert D. Shedd; Brian J. Cromarty

(57) ABSTRACT

The invention concerns a device for receiving and/or transmitting signals comprising at least two wave reception and/or transmission means consisting of a slot antenna and means for connecting at least one of said reception and/or transmission means to means using multibeam signals. The connection means consist of a common feeder line, the line being electromagnetically coupled with the slots of the slot antenna and being terminated by an electronic component enabling through a control signal to simulate a short circuit or an open circuit at the end of said line so that, when the component is in on-state the radiation pattern derived from the device is different from the radiation pattern derived from the device when the component is in off-state. The invention is applicable to the field of wireless transmissions.

10 Claims, 7 Drawing Sheets

(a) 1er HIGHER MODE (b) FUNDAMENTAL MODE

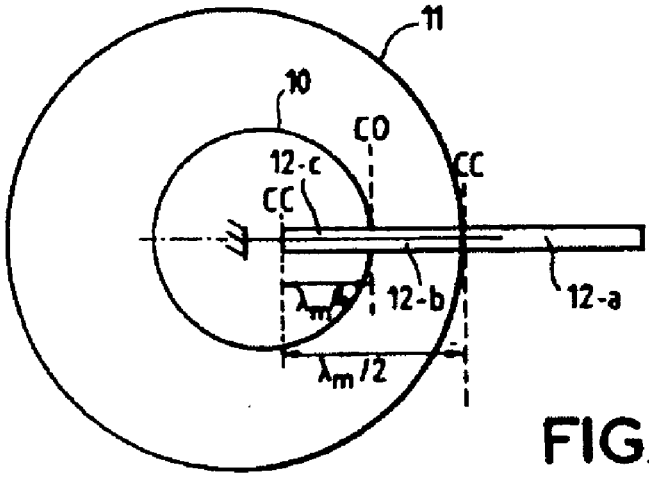
FIG.5A
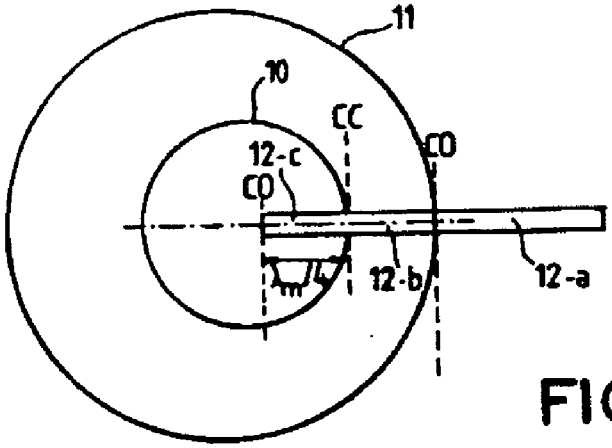
FIG.5B
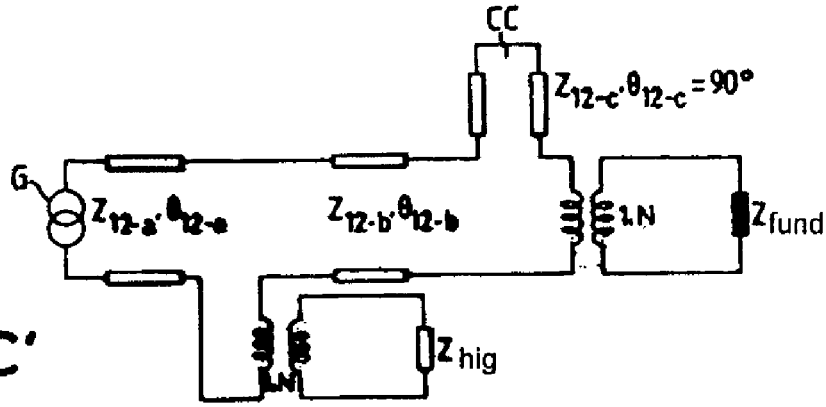
FIG.5C
FIG.5C'
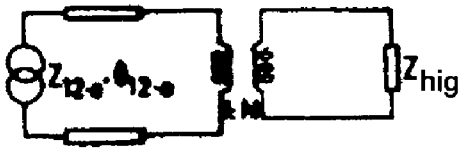

DEVICE FOR RECEIVING AND/OR TRANSMITTING ELECTROMAGNETIC SIGNALS FOR USE IN THE FIELD OF WIRELESS TRANSMISSIONS

This application claims the benefit, under 35 U.S.C. § 365 and is 371 of International Application PCT/FR02/00408, filed Feb. 4, 2002, which was published in accordance with PCT Article 21(2) on Sep. 6, 2002 in French and which claims the benefit of French patent application No. 0102500, filed Feb. 23, 2001.

The present invention relates to a device for the reception and/or the transmission of signals which can be used in the field of wireless transmissions, in particular in the case of transmissions in an enclosed or semi-enclosed environment such as domestic environments, gymnasiums, television studios or auditoria, stadiums, railway stations, etc.

In the known systems for high-throughput wireless transmissions, the signals sent by the transmitter reach the receiver along a plurality of distinct routes. When they are combined at receiver level, the phase differences between the various rays which have travelled routes of different length give rise to an interference figure liable to cause fadeouts or a considerable degradation of the signal. Thus, as represented in FIG. 1 which relates to the spatial distribution of the power measured around a point in a wireless link in an enclosed environment at the frequency of 5.8 GHz, the power of the received signal varies by several tens of decibels over very short distances of the order of a fraction of the wavelength. Moreover, the location of the fadeouts changes over time as a function of the modifications of the surroundings, such as the presence of new objects or the passage of people. These fadeouts due to multipaths may engender considerable degradations both as regards the quality of the signal received and as regards the performance of the system.

To remedy the problem of fadeouts relating to multipaths, use is currently made of directional antennas which, through the spatial selectivity of their radiation patterns, make it possible to reduce the number of rays picked up by the receiver, thus attenuating the effect of the multipaths. In this case, several directional antennas associated with signal processing circuits are required to ensure spatial coverage of 360°. French Patent Application No. 98 13855 filed in the name of the applicant also proposes a compact multibeam antenna making it possible to increase the spectral efficiency of the array. However, for a number of items of domestic or portable equipment, these solutions remain bulky and expensive.

To combat fadeouts, the technique most often used is a technique using space diversity. As represented in FIG. 2, this technique consists among other things in using a pair of antennas with wide spatial coverage such as two antennas of the patch type (1, 2) which are associated with a switch 3. The two antennas are spaced apart by a length which must be greater than or equal to $\lambda o/2$ where $\lambda o$ is the wavelength corresponding to the operating frequency of the antenna. With this type of device, it can be shown that the probability of the two antennas being simultaneously in a fadeout is very small. The proof results from the description given in "Wireless Digital Communications", Dr Kamilo Feher—chapter 7: Diversity Techniques for Mobile-Wireless Radio Systems, in particular from FIG. 7.8, page 344. It can also be proven through a pure probability calculation with the assumption that the levels received by each patch are completely independent. It can be stated, in this case, that if p (1% for example) is the probability that the signal received by an antenna has a level lower than a detectability threshold, then the probability that this level is below the threshold for the two antennas is $p^2$ (hence 0.01%). If the two signals are not perfectly uncorrelated, then $p_{div}$ is such that $0.01\% < p_{div} < 1\%$, where $p_{div}$ is the probability that the level received is lower than the detectability threshold in the case of diversity.

Thus, by virtue of the switch 3, it is possible to select the branch linked to the antenna exhibiting the highest level by examining the signal received by way of a monitoring circuit (not represented). As represented in FIG. 2, the antenna switch 3 is connected to a switch 4 making it possible to operate the two patch antennas 1 or 2 in transmission mode when they are linked to the T×5 circuit or in reception mode when they are linked to the R×6 circuit.

To solve in particular the compactness problems, Patent U.S. Pat. No. 5,714,961 has proposed that the radiation diversity be achieved by using two annular slots operating on different modes, the radiation pattern of the slots being controlled with the aid of a network of feed lines.

The aim of the present invention is to propose an alternative solution to the one described hereinabove, which has the advantages in particular of greater compactness, lower cost and greater simplicity of implementation.

Accordingly, the subject of the present invention is a device for the reception and/or the transmission of electromagnetic signals comprising at least two means of reception and/or of transmission of waves, the said device consisting of a slot type antenna, and means for connecting at least one of the said means of reception and/or of transmission to means of utilization of the signals, characterized in that the means of connection consist of a common feed line, the line being coupled electromagnetically with the said slot type antennas and terminating in an electronic component making it possible by virtue of a control signal to simulate a short-circuit or an open circuit at the extremity of the said line so that, when the component is in the on state the radiation pattern emanating from the device is different from the radiation pattern emanating from the device when the component is in the off state.

According to a first embodiment, the slot type antennas consist of at least two resonant slots one inside the other, one of the slots operating in its fundamental mode and the other slots operating in a higher mode. In this case, the slots may be of annular, square or rectangular shape or have any other compatible shape. Moreover, the slots may be furnished with means allowing the radiation of a circularly polarized wave. With a device of this type, when the electronic component is in the on state, the radiation pattern obtained is that of the outer slot, whereas, when the electronic component is in the off state, the radiation pattern obtained results from the combination of the radiation pattern of the inner slot and of the radiation pattern of the outer slot. In this latter case, the amplitude-wise and phase-wise adjustment of the contributions of each mode is achieved by adjusting the width of the feed line and by the gap between the centres of the two slots.

According to another embodiment, the slot type antennas consist of Vivaldi type antennas regularly spaced around a central point.

According to a characteristic of the present invention, on the side opposite the means of utilization of the signals, the feed line is linked to an electronic component such as a diode, a transistor arranged as a diode, MEMs (standing for Micro Electro Mechanical systems), which, according to its state of bias makes it possible to simulate a short-circuit (when it is forward biased with a positive voltage) or an open circuit (no bias voltage: V=0) at the extremity of the line: the length of the line between the electronic component and the first slot electromagnetically coupled to the said line, as well as the length between the first slot and the second slot that are electromagnetically coupled to the line are equal, at the central frequency of operation, to an odd multiple of $\lambda m/4$ where $\lambda m=\lambda o/\sqrt{\epsilon reff}$ with $\lambda o$ the wavelength in vacuo and $\epsilon reff$ the equivalent relative permittivity of the line and moreover the length of the line between the subsequent successive slots is equal to a multiple of $\lambda m/2$.

According to an embodiment, the feed line is a line embodied in microstrip technology or in coplanar technology. Moreover, the means of utilization of the signals comprise a control means sending over the feed line a voltage greater than or equal to the turn-off voltage of the component as a function of the level of the signals received.

Other characteristics and advantages of the present invention will become apparent on reading the description of various embodiments, this reading being undertaken with reference to the appended drawings in which:

FIG. 1 already described represents the spatial variation of the power of an antenna in an interior environment.

FIG. 2 already described is a diagrammatic plan view of a space diversity transmit/receive device.

FIGS. 5A to 5E are respectively diagrammatic views identical to those of FIG. 3 explaining the manner of operation of the present invention as well as the equivalent circuit diagrams.

Figure 8:
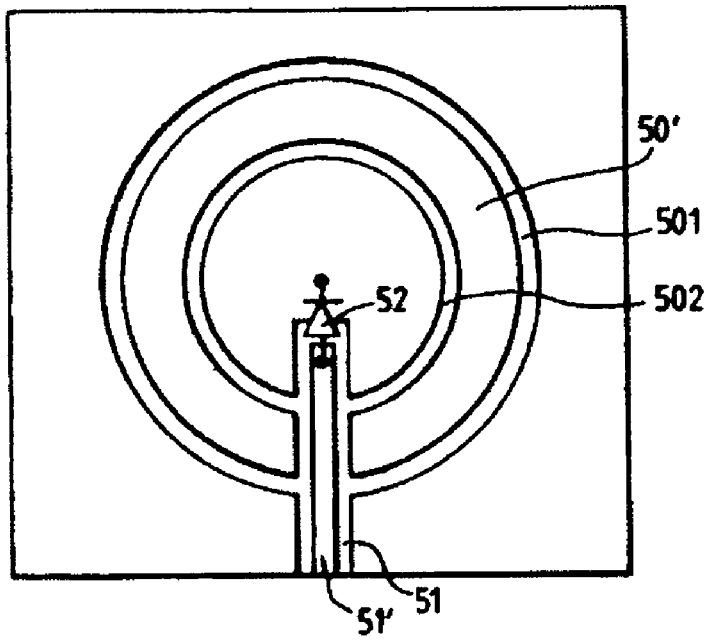

FIG. 8 diagrammatically represents another embodiment of a transmit/receive device in accordance with the present invention.

Figure 9A:
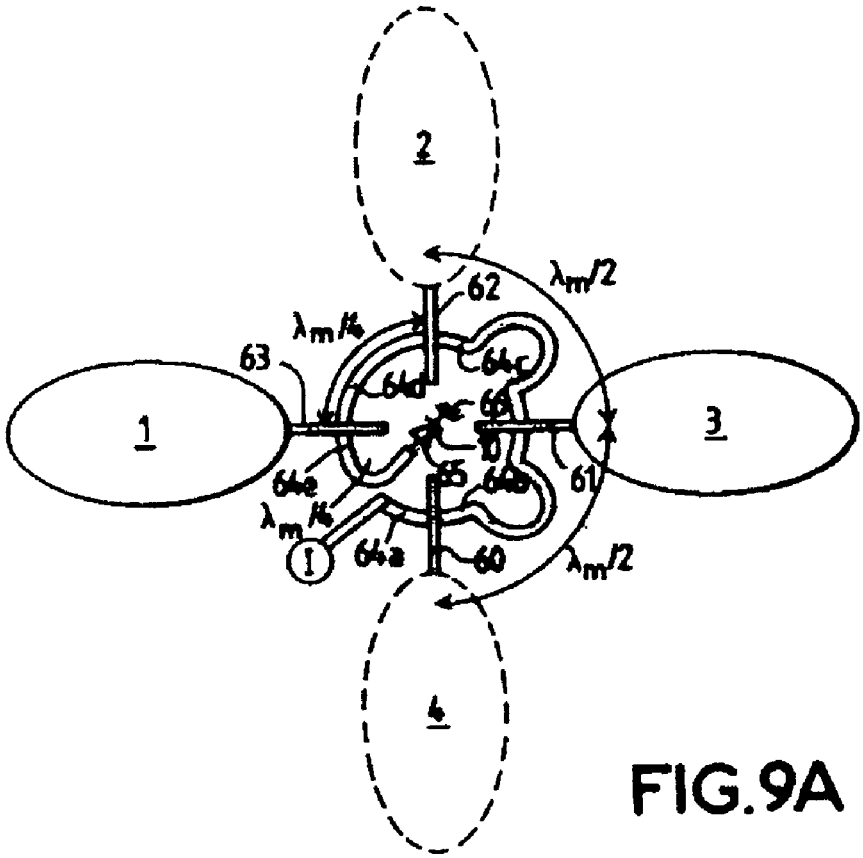
Figure 9B:
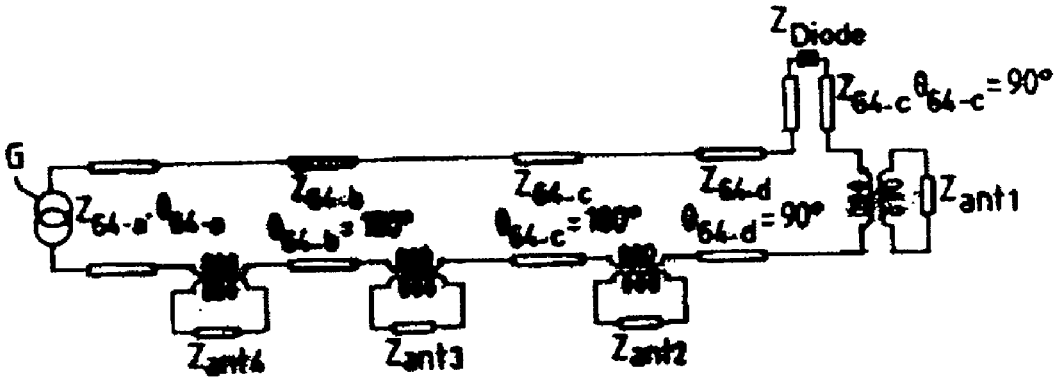

FIGS. 9A and 9B are respectively a diagrammatic view of a transmit/receive device in accordance with the present invention in the case of antennas fed by slots consisting of Vivaldi type antennas and the equivalent circuit diagram thereof.

Figure 10:
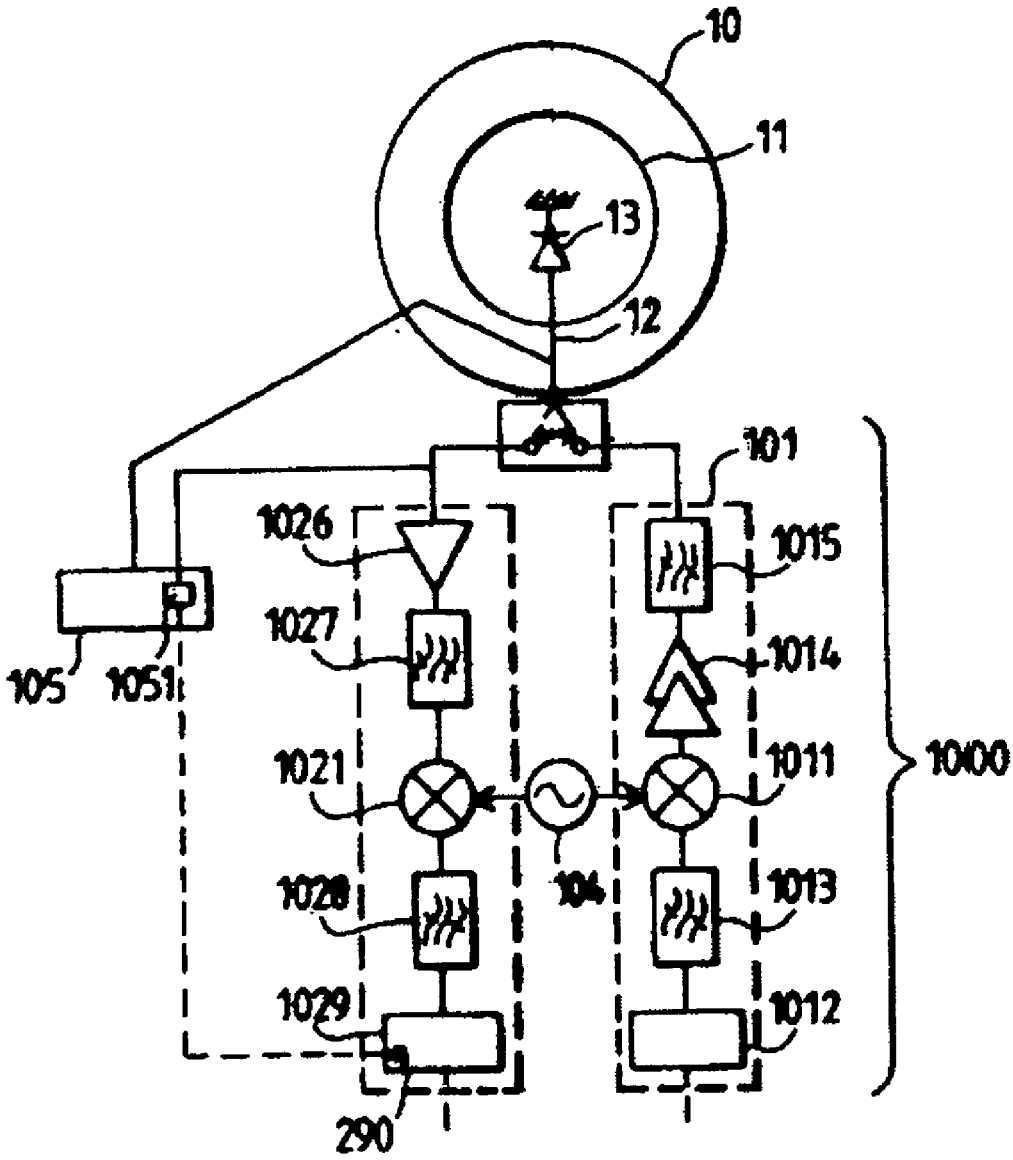

FIG. 10 is a view of a transmit/receive device connected to utilization means in accordance with the present invention.

To simplify the description, in the figures the same elements bear the same references.

Figure 3:
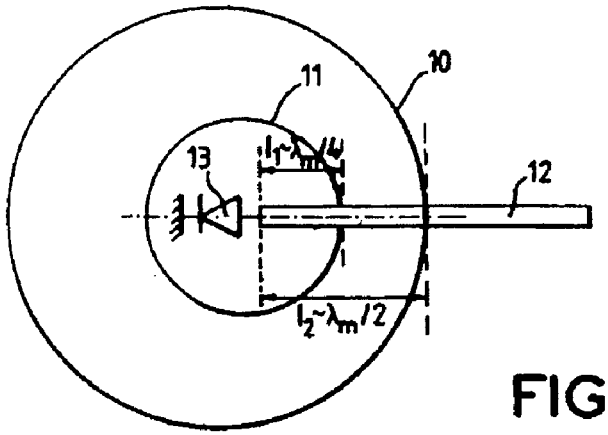
FIG. 3 is a diagrammatic view from above representing a topology of a transmit/receive device in accordance with the present invention.
Figure 4A:
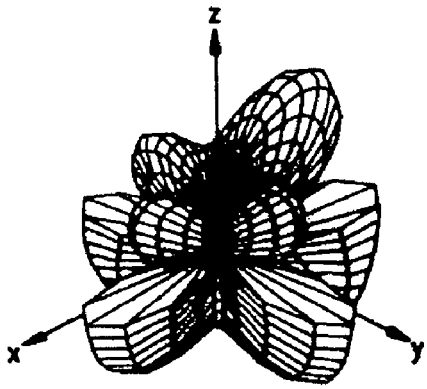
FIGS. 4A and 4B represent the radiation of an annular slot in its fundamental mode and in a first higher mode.
Figure 4B:
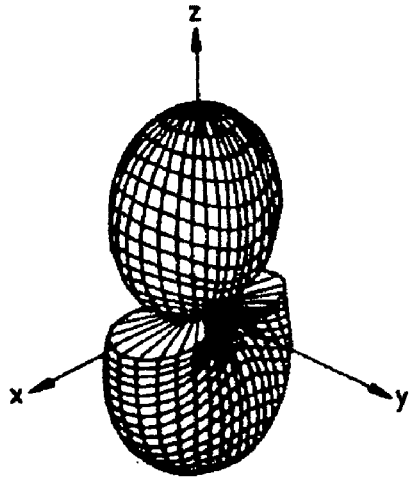

Represented diagrammatically in FIG. 3 is a first embodiment of a device for transmitting/receiving waves in accordance with the present invention. In this case, the wave transmission/reception means are slot type antennas. More particularly, they consist of two antennas 10, 11 of the annular slot type, positioned one inside the other. The two antennas of annular slot type 10 and 11 are dimensioned such that the inner annular slot 11 operates in its fundamental mode as represented in FIG. 4B, while the outer annular slot 10 operates in the first higher mode as represented in FIG. 4A. The radiation patterns of FIGS. 4A and 4B corresponding to each mode being different, the power levels resulting from the combination of the rays picked up for each antenna through its radiation pattern are therefore different. Just as in the case of space diversity, it can be shown that it is improbable that the levels picked up through two different combinations of the two patterns would correspond simultaneously to two fadeouts. Specifically, the level received by an antenna is proportional to the resultant (amplitude-wise and phase-wise vector addition) of the fields of the various "rays" picked up through its radiation pattern. Since the rays have generally travelled different routes, their amplitudes and their phases are generally different so that their resultant may provide a signal close to 0, namely a fadeout or on the contrary may combine constructively, namely give a signal peak. Since the combinations of the patterns through which the multipaths are picked up are different, there is little chance of the resulting signals corresponding simultaneously to a fadeout. It can therefore be proven with a simple probability calculation such as that mentioned hereinabove. With this arrangement, it is therefore possible to combat fadeouts related to multipaths with equivalent effectiveness to that obtained in conventional space diversity on condition that it is possible to switch simply from one slot to another. To do this, as represented in FIG. 3 and explained with reference to FIGS. 5A and 5B, the two annular slots 10 and 11 are coupled electromagnetically to a common feed line connected to means of utilization of the signals (not represented). The feed line 12 consists in the embodiment, of a microstrip line crossing the two slots 10 and 11.

Figure 5D:
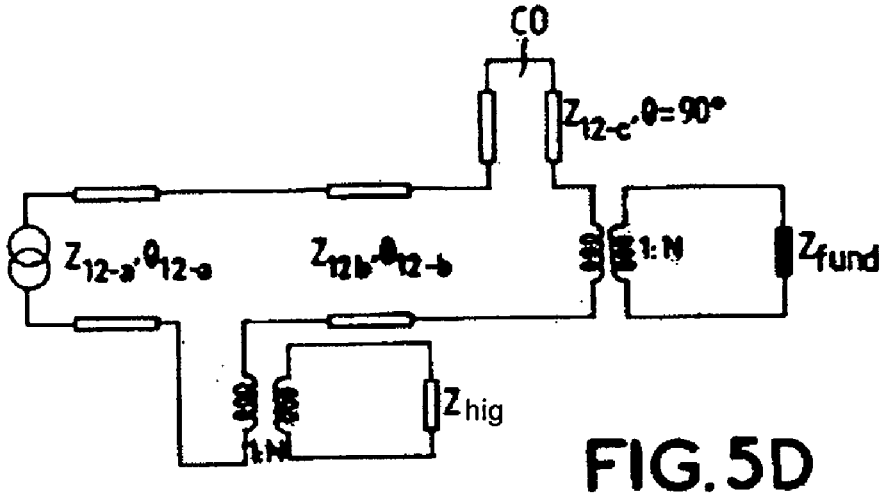

In accordance with the present invention, the end of the microstrip line 12 is connected to a diode 13, in the embodiment represented, the other end of which is linked to earth. The diode 13 can be a PIN type diode (namely the diode referenced HS-LP 489 B from H.P.). Moreover, as represented in FIG. 3, the length 11 of the feed line between one of the terminals of the diode 13 and the first annular slot 11 is equal to $\lambda m/4$ or to an odd multiple of around $\lambda m/4$ with $\lambda m=\lambda o/\sqrt{\epsilon reff}$, $\lambda o$ being the wavelength in vacuo and $\epsilon reff$ the equivalent relative permittivity of the line. Likewise, as represented in FIG. 3, the length 12 of the feed line between the connection to the diode 13 and the second annular slot 10 is equal to around $\lambda m/2$, or generally to a multiple of $\lambda m/2$ with for $\lambda m$ the values given hereinabove. The manner of operation of the device in accordance with the present invention will now be explained with reference to FIGS. 5A to 5D. When the diode 13 is in the on state, namely when a dc bias voltage +V is sent through the line, as represented in FIG. 5A, the end of the line 12 opposite the excitation means is in a short-circuit plane. Given the dimensioning of the line given hereinabove, the crossover plane between the microstrip line 12 and the first antenna 10 is equivalent to an open circuit plane whereas the crossover plane with the second slot 11 corresponds to a short-circuit plane. Under these conditions, as shown by the equivalent diagram of FIG. 5C only the antenna of outer annular slot type 11 is excited and the antenna pattern is that of the first higher mode, namely that represented in FIG. 4A. The equivalent diagram of FIG. 5C has been obtained from the known equivalent diagram of a simple transition between a microstrip line and a slot line proposed for the first time by B. Knorr, when operating near to resonance. The circuit consists of an impedance, denoted Zfund, of the fundamental mode corresponding to the annular slot 10. The impedance is linked to an impedance transformer of ratio N:1. The other branch of the impedance transformer is connected in series to the resistor (corresponding to the short-circuiting of the end of the line 12) referred back by the line extremity 12*c* of characteristic impedance $Z_{12c}$ and of electrical length $\theta_{12c}$ with the microstrip line 12*b* of characteristic impedance $Z_{12b}$ and of electrical length $\theta_{12c}$. This line is linked to another impedance transformer of ratio 1:N linked to the equivalent circuit $Z_{hig}$ of the annular slot 12. The assembly 12 is linked by a length of microstrip line 12*a* of characteristic impedance $Z_{12a}$ and of electrical length $\theta_{12a}$ to an excitation circuit symbolized by the generator G. A short-circuit CC of the diode refers back an open circuit CO via the line 12*c* which is a quarter wave. The line 12*b,* also a quarter wave, likewise refers back a short-circuit CC. One therefore has the equivalent diagram of FIG. 5C' which corresponds to operation with one slot where only the slot operating in the higher mode is excited.

Figure 5E:
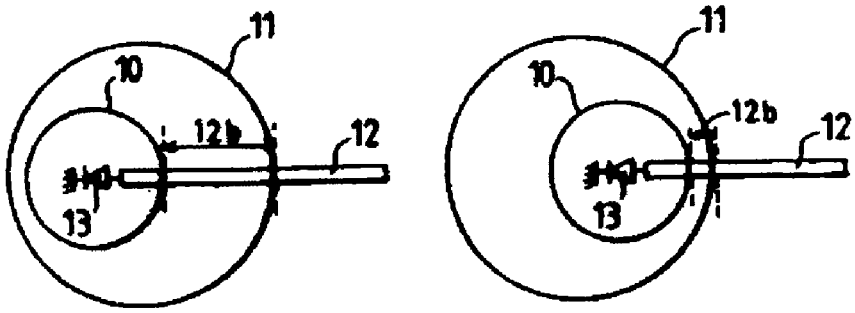

When, as represented in FIG. 5B, the diode 13 is in the off state, namely G is at zero bias voltage, the end of the line connected to the diode is in an open circuit plane CO. Under these conditions, as shown by the equivalent diagram of FIG. 5D, both slots are excited since this time the open circuit CO of the diode refers back a short-circuit CC via the quarter wave line 12*c*. The antenna pattern is that resulting from the fundamental mode originating from the small slot 10 and from the higher mode originating from the large slot 11. The amplitude weighting of each mode can be adjusted through the relative values of the impedances referred back by each mode at the input of the antenna through the excitation line 12. The phase weighting can be adjusted via the spacing between the centres, namely the length 12*b* of the two slots, as depicted in FIG. 5E.

Moreover in order that, when operating in on mode in respect of the diode, the antenna device should allow the excitation of only the higher mode of the outer slot, the length 12*b* must be equal to around an odd multiple of λm/4.

Figure 1:
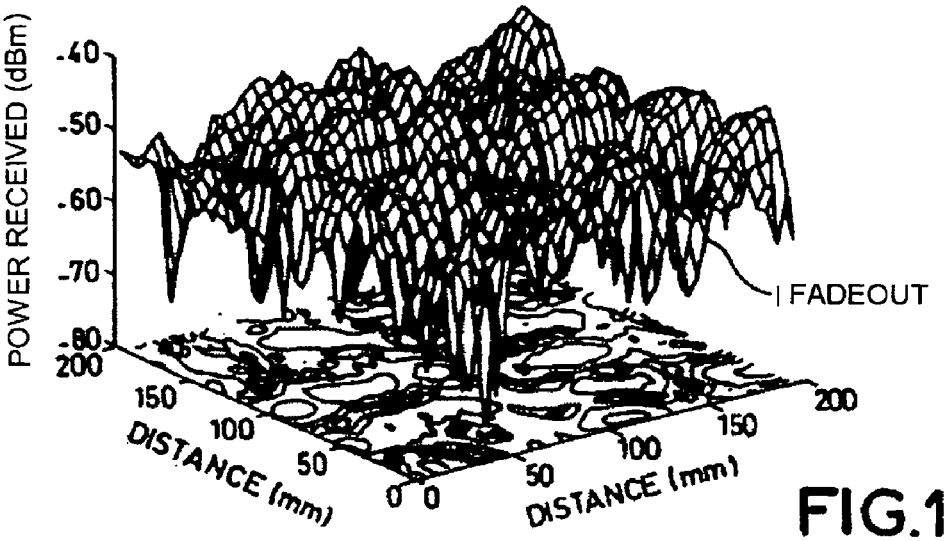
Figure 2:
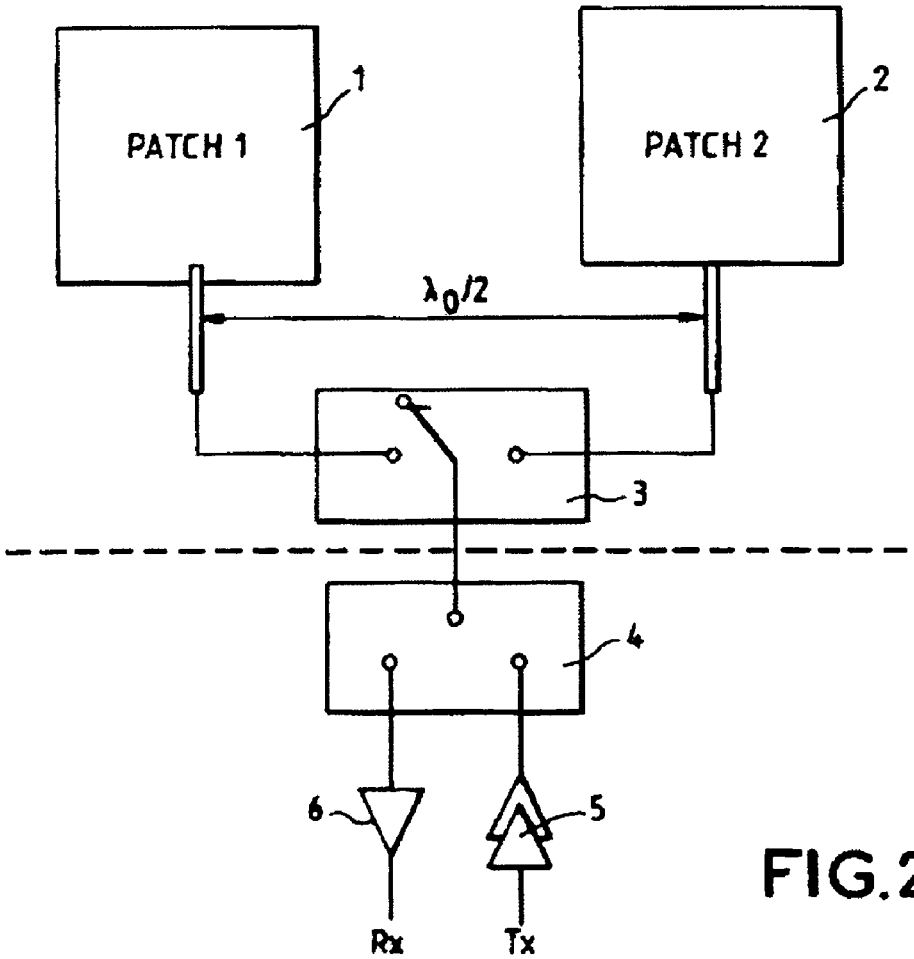

The solution described above makes it possible to obtain a signals transmit/receive device that is more compact than the device represented in FIG. 2. Furthermore, in this case, a simple diode is used instead of a switch with three terminals, thereby making it possible to reduce the cost of the device and also the switching losses, and a single common feed line is used, thereby simplifying the implementation of the system.

Figure 6:
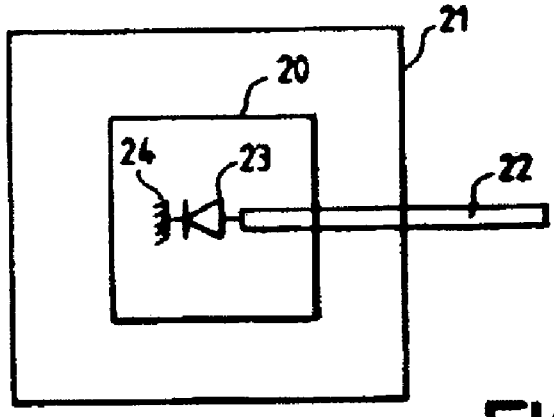
FIG. 6 is a diagrammatic view of a transmit/receive device in accordance with a second embodiment of the present invention.
Figure 7A:
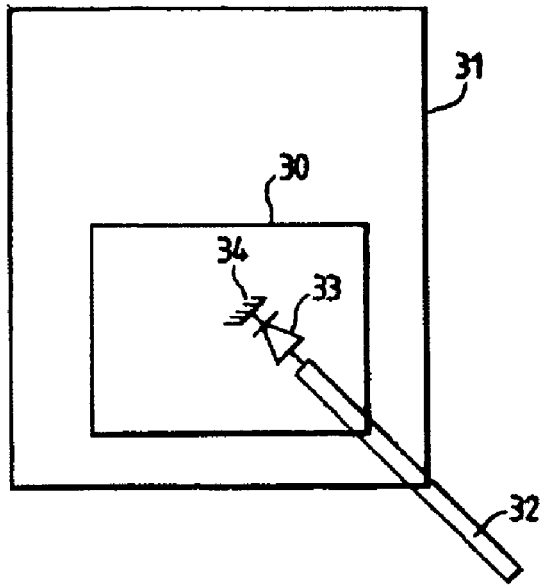
FIGS. 7A and 7B are views representing slots whose shape is respectively identical to those of FIGS. 6 and 3 but for a circularly polarized manner of operation.
Figure 7B:
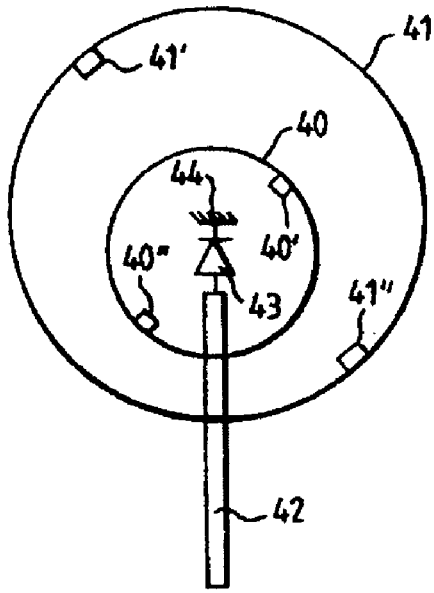

Various other embodiments of transmit/receive antennas of slot type that can be used within the framework of the present invention will now be described with reference to FIGS. 6 to 10. Thus, as represented in FIG. 6, the slot-fed antennas consist of two square shaped slots 20, 21 positioned one inside the other and fed by a microstrip feed line 22 connected in series to a diode 23 whose other end is linked to an earth plane symbolized by 24. The feed line 22 is positioned with respect to the square slots 20 and 21 in such as way as to have linearly polarized operation. Represented in FIGS. 7A and 7B are slot type antennas similar to those of FIGS. 3 and 6. However, these antennas are modified in such a way as to be able to operate under circular polarization. Thus, in FIG. 7A, the slots 30 and 31 consist of two squares nested one inside the other fed by a microstrip line 32 according to one of the diagonals of the squares, this feed line terminating in a diode 33 connected in series between one of the ends of the line 32 and the earth plane 34. In the case of FIG. 7B, the slots consist of two annular slots 40, 41 one inside the other, the annular slots being furnished with known means for producing circular polarization, namely diagonally opposite notches 40', 40", 41', 41".

In accordance with the present invention, the annular slots 40 and 41 are excited by a feed line 42 crossing the two slots 40 and 41 according to a dimensioning as given hereinabove, the end of the line 42 being connected to a diode 43 linked in series between the line 42 and an earth plane 44. Represented in FIG. 8 are two slot type antennas and a common feed line that are embodied in coplanar technology. In this case, the excitation of the annular slots is effected via the coplanar line 51. The diode 52 is then arranged between the metallic element 51' of the feed line 51 and the metallic part 50' of the substrate on which the antenna-forming annular slots $\mathbf{50}_1$ and $\mathbf{50}_2$ are embodied.

FIGS. 9A and 9B relate to another embodiment of a device in accordance with the present invention in the case where the wave reception and/or transmission means consisting of a slot type antenna consist of Vivaldi type antennas. In this case, the Vivaldi type antennas are regularly spaced around a central point referenced O in the figures so as to obtain considerable spatial coverage.

Represented in FIG. 9A are wave reception and/or transmission means consisting of four Vivaldi antennas positioned perpendicularly to one another, these antennas of known shape being symbolized by the slots 60, 61, 62, 63. The structure of Vivaldi antennas being well known to the person skilled in the art, it will not be described in greater detail within the framework of the invention. In accordance with the present invention, the four Vivaldi antennas 60, 61, 62, 63 are excited by way of a single feed line 64 embodied, for example, in microstrip technology. This feed line crosses the slots of the four Vivaldi antennas in such a way that:

i) the length of the line interval situated between the first two slots, reckoned from the end of the line linked to the diode (slot 63 and slot 62), is equal to λm/4, more generally to an odd multiple of around λm/4, ii) the length of all the other line intervals between two successive slots (i.e. therefore in the case of FIG. 9, between the slots 62 and 61 and between the slots 61 and 60) is equal to λm/2, more generally to a multiple of around λm/2.

In accordance with the present invention, a diode 65 is linked between the end of the feed line 64 and an earth plane 66. The distance between the last Vivaldi antenna 63 and the diode 65 is λm/4 or an odd multiple of λm/4. With this particular layout of a device for the reception and/or transmission of multibeam signals, as shown by the equivalent diagram of FIG. 9B, the resulting pattern of the antenna corresponds to the beams (2), (3), and (4) when the diode 65 is in the on state, namely its bias voltage is positive. This equivalent diagram corresponds to that of 4 microstrip line/slot line transitions as described by Knorr, separated by electrical lengths corresponding to the line lengths indicated in FIG. 9A and to the impedance of the diode situated at the extremity of the exciter microstrip. When the diode is in the off state (V=0) the resulting pattern corresponds to the four beams: (1), (2), (3), and (4).

The present invention has been described using a diode as electronic component. However, the diode may be replaced by a transistor, a MEM (Micro Electro Mechanical system) or any equivalent known system. Likewise, the slot type antenna may have any compatible polygonal shape other than the shapes represented.

An embodiment of a circuit for utilizing the transmission and reception signals and which may be used within the framework of the present invention will now be described with reference to FIG. 11. In this case, the feed line 12 links the signals utilization circuit 100 to the antennas device 10, 11 via a switch 103. The circuits 100 comprise a transmission circuit 101 linked to an input of the switch 103 for the conversion to high-frequency of the signals to the antennas system and a reception circuit 102 linked to a terminal of the switch 101 for the conversion to intermediate frequency of the signals received by the antennas device 10, 11. In a known manner, each circuit 101, 102 respectively comprises a mixer 1011, 1021 and one and the same local oscillator 104 is used at the input of the said mixers for the frequency transposition. The circuit 101 of the up pathway comprises at the input a modulation circuit 1012 for the incoming baseband signals linked at the output to an input of a filter 1013 for rejecting the image frequency. The output of the filter is linked to an input of the mixer 1011. The outgoing signals from the mixer have been converted to high-frequency and drive the input of a power amplifier 1014 whose output is linked to the input of a bandpass filter 1015 whose passband is centred around the transmission frequency. At input the circuit 102 comprises a low-noise amplifier 1026 linked at its input to a switch output 103 and at output to a filter 1027 for rejecting the image-frequency of the convertible signals. The output of the filter is linked to an input of the mixer 1021 whose output provides the transposed signals with the aid of the intermediate frequency oscillator 104. These signals, after filtering by the bandpass filter 1028 whose passband is centred around the intermediate frequency, are sent to a demodulation circuit 1029 able to demodulate the said baseband signals. The signals at the output of the circuit are then provided to processing circuits. Moreover, the signal received by the reception circuit is measured by a microprocessor 105 and recorded in a register 1051. This measurement is performed regularly at predetermined time intervals which are short enough for it not to be possible for any information loss to occur. When the level of the signal is below a prerecorded threshold, the microcontroller sends a voltage V over the feed line making it possible to turn the diode on or off in such a way as to excite certain of the slots, in accordance with the present invention. In the embodiment, the method of selecting the optimal beam is performed according to a method of radiation diversity with predetection, the choice of the beam being made upstream of the signals utilization means by determining the beam whose signal level is highest. Other methods may be employed, in particular a method of radiation diversity with post-detection in respect of the choice of the optimal beam, the choice the beam then being made downstream of the circuits 100 by selecting the pathway exhibiting the best error rate. In this case, the demodulator comprises a circuit for calculating the Bit Error Rate (BER). It is obvious to the person skilled in the art that the invention is not limited to the embodiments and variants described hereinabove.

What is claimed is:

1. Device for the reception and/or the transmission of signals comprising at least two slot type antennas, and means for connecting at least one of said slot antennas to means of utilization of the multibeam signals, wherein the means for connecting consist of a common feed line, the line being coupled electromagnetically with the said slot type antennas and terminating by an electronic component making it possible by virtue of a control signal to simulate a short-circuit or an open circuit at the extremity of the said line so that, when the component is in the on state the radiation pattern emanating from the device is different from the radiation pattern emanating from the device when the component is in the off state.

2. Device according to claim 1, wherein the slot type antennas consist of at least two resonant slots one inside the other, one of the slots operating in its fundamental mode and the other slots operating in a higher mode.

3. Device according to claim 2, wherein feed line has a width and between the centres of the two slots is a gap chosen so as to give an amplitude-wise and phase-wise adjustment of the various modes of operation, when the component is in the off state.

4. Device according to claim 2, wherein the slots are of annular, square, rectangular or polygonal shape.

5. Device according to claim 2, wherein the slots are furnished with means allowing the radiation of a circularly polarized wave.

6. Device according to claim 1, characterized in that the slot type antennas consist of several Vivaldi type antennas regularly spaced around a central point.

7. Device according to claim 1, wherein, on the one hand, the length of the line between the electronic component and the first slot electromagnetically coupled to the said line, as well as the length between the first slot and the second slot that are electromagnetically coupled to the line are equal, at the central frequency of operation, to an odd multiple of $\lambda m/4$, and the length of the line between the subsequent successive slots is equal to a multiple of $\lambda m/2$ where $\lambda m=\lambda o/\sqrt{\epsilon reff}$ with $\lambda o$ the wavelength in vacuo and $\epsilon reff$ the equivalent relative permittivity of the line.

8. Device according to claim 7, wherein the feed line is a line embodied in microstrip technology or in coplanar technology.

9. Device according to claim 1, wherein the electronic component consists of one from the group of diode, transistor, Micro Electro Mechanical system.

10. Device according to claim 1, wherein the means of utilization of the signals comprise a control means sending over the feed line a voltage greater than or equal to the turn-off voltage of the component as a function of the level of the signals received.

* * * * *